US005819830A

United States Patent [19]

Verelst

[11] Patent Number: 5,819,830

[45] Date of Patent: Oct. 13, 1998

[54] MANUALLY UNROLLABLE AWNING ASSEMBLY

[75] Inventor: Jan Robert Marcel Verelst, Menen, Belgium

[73] Assignee: Brutsaert Accessories N.V., Menen, Belgium

[21] Appl. No.: 701,798

[22] Filed: Aug. 26, 1996

[30] Foreign Application Priority Data

Aug. 24, 1995 [BE] Belgium ..... 09500707

[51] Int. Cl.[6] ..... E04F 10/00

[52] U.S. Cl. ..... 160/22; 160/46; 160/66

[58] Field of Search ..... 160/22, 66, 67, 160/69, 70, 72, 73, 78, 79, 46; 135/88.11, 88.12

[56] References Cited

U.S. PATENT DOCUMENTS

| | | | |
|---|---|---|---|
| 4,733,683 | 3/1988 | Pozzi | 160/22 X |
| 4,997,021 | 3/1991 | Brutsaert | 160/22 |
| 5,242,003 | 9/1993 | Pozzi | 160/22 |
| 5,333,663 | 8/1994 | Eger | 160/22 |
| 5,492,162 | 2/1996 | Lohausen | 160/22 |

*Primary Examiner*—David M. Purol
*Attorney, Agent, or Firm*—Bacon & Thomas

[57] ABSTRACT

A manually unrolling awning assembly includes a supporting frame (1) and an awning (2) which can be rolled up and unrolled, wherein the supporting frame (1) has a fixed rear part (3) in which the cloth (2) can be rolled up on a roller (4), and a front part (5) which can be moved relative to this fixed rear part (3), and to which the foremost edge of the cloth (2) is fixed. The fixed part includes a locking element (16) on at least one end which is mounted in a displaceable manner on the fixed end (3) of the supporting frame (1) and which can cooperate with a catch (17), when the cloth (2) is entirely rolled up and in locking position, and which is fixed to the movable front part (5), in order to lock this catch (17), so that the front part (5) of the supporting frame (1) cannot move forward and, consequently, so that the cloth (2) cannot unroll. The locking element (16) can be moved manually from the above-mentioned locking position until the locked catch (17) is free.

9 Claims, 4 Drawing Sheets

MANUALLY UNROLLABLE AWNING ASSEMBLY

BACKGROUND OF THE INVENTION

1. Field of the Invention

The present invention concerns a manually unrolling awning assembly including a supporting frame and an awning cloth which can be rolled up and unrolled, wherein the supporting frame has a fixed rear part in which the cloth can be rolled up on a roller, and a front part which can be moved in relation to this fixed part, and to which the foremost edge of the cloth is fixed.

2. Discussion of Related Art

The unrolling of the awning cloth is carried out manually by pulling it forward by means of the movable front part. The rolling up is carried out by means of a spring which is integrated in the roller and which is clamped or tensioned as the cloth is unrolled.

When the clot is entirely rolled up, this movable front part fits up against the fixed rear part of the supporting frame.

With known awnings of the above-mentioned type, the front part can move forward unintentionally and the cloth can be accidentally or inadvertently unrolled.

With awnings having a mechanism for rolling up and unrolling the cloth, the mechanism itself can prevent undesired unrolling or it can control a locking device which makes said undesired unrolling impossible, but since there is no mechanism for the rolling up and unrolling the cloth, such a solution is impossible for awnings of the above-mentioned type, which are manually unrolled.

BRIEF SUMMARY OF THE INVENTION

The invention aims to remedy this disadvantage and to provide a manually operable or unrolling awning which cannot unroll undesirably from a rolled-up position.

This aim is reached according to the invention in that the awning contains a locking element on at least one end which is mounted in a displaceable manner on the fixed end of the supporting frame and which can cooperate with a catch, when the cloth is entirely rolled up and in locking position, which is fixed to the movable front part, in order to lock this catch, so that the front part of the supporting frame cannot move forward and, consequently, so that the cloth cannot unroll, and whereby the locking element can be moved manually from the above-mentioned locking position until the locked catch is free.

Preferably, such a locking element which works in conjunction with a catch is mounted on each end of the awning.

The fixed rear part of the supporting frame may consist of a strut and end parts, and the locking element is mounted in a displaceable manner on an end part.

Preferably, the locking element can be moved up and down and a spring can be provided which pushes or biases this locking element downward.

The active part of the locking element which can stop the catch is effectively bevelled at the bottom, so that when the awning is rolled up and locked, said catch makes contact with the bevel and automatically pushes up the locking element from the locking position until the catch ends up behind the bevelled part and the locking element can return to the locking position.

According to a special embodiment of the invention, the movable front part has two hinged struts connected to one another along their longitudinal direction, namely a rear base strut and a front cover strut, and the above-mentioned catch is situated at one end of the cover strut.

The two struts of the above-mentioned front part of the supporting frame, when they are turned towards one another, form an enclosed space for storing folding supporting arms which are hinge-mounted to either of these struts. The front cover strut forms a handle to pull forward the front part and thus for unrolling the cloth.

DESCRIPTION OF THE DRAWINGS

In order to better explain the characteristics of the invention, a manually unrolling awning according to the invention is described hereafter, as an example only without being limitative in any way, with reference to the accompanying drawings, where.

DETAILED DESCRIPTION

Figure 1:
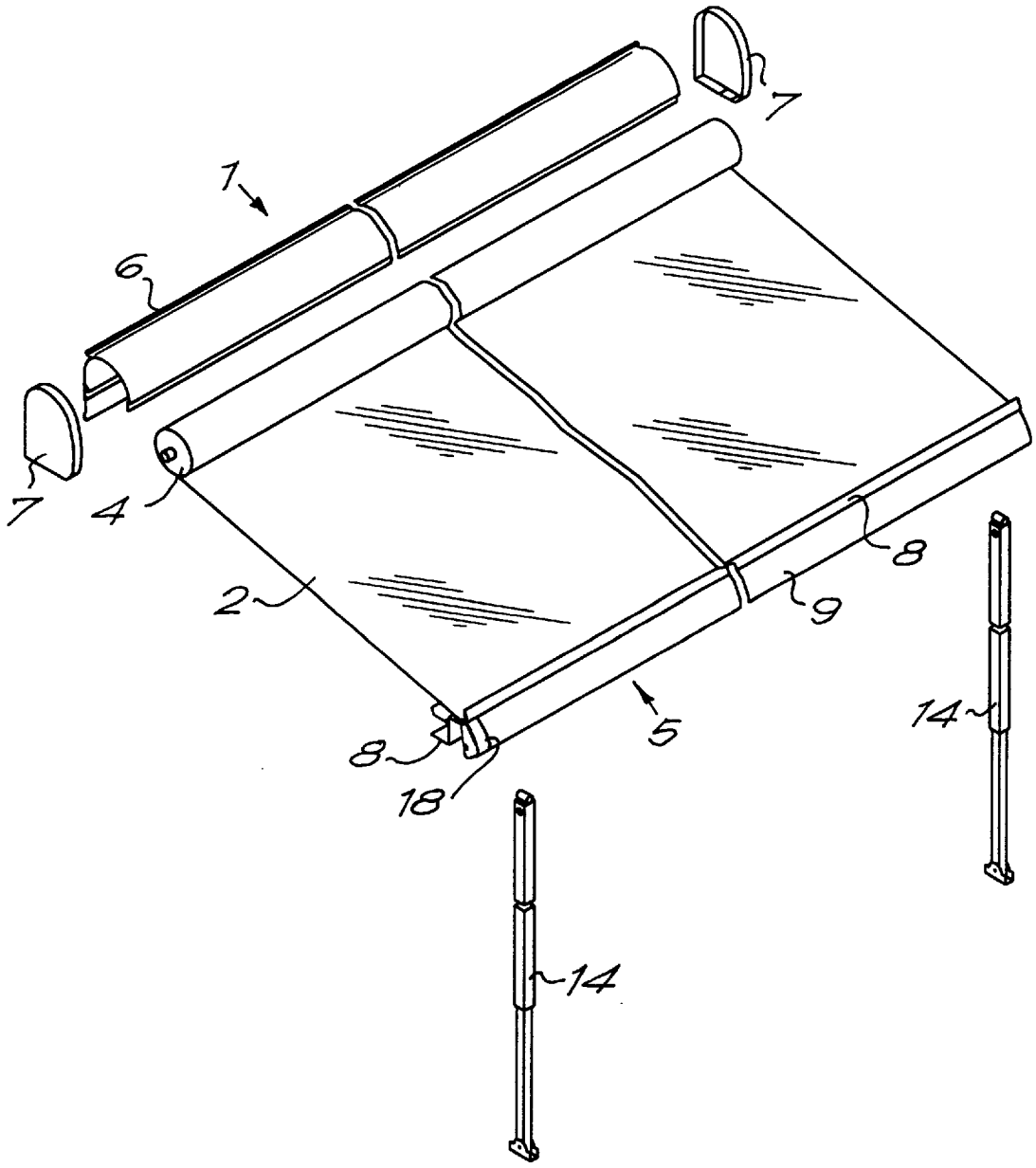
FIG. 1 schematically shows a view in perspective of an awning according to the invention, with the parts represented as separate.

As is represented in FIGS. 1 to 7, the invention concerns a manually unrolling awning which mainly comprises a supporting frame 1 and a cloth 2 which can be rolled up and unrolled, wherein the supporting frame has a fixed rear part 3 in which the awning can be rolled up on a roller 4, and a front part 5 which can be moved relative to this fixed part 3, and to which the foremost edge of the cloth 2 is fixed.

The fixed rear part 3 forms a case and consists of a fixed strut 6 and two end parts 7 in between which the roller 4 is mounted in a rotatable manner. The strut 6 can be fixed against the wall of a building or the wall of a trailer, mobile home, tent or such by means of fasteners.

The movable front part 5 mainly consists of two parallel struts, namely a rear base strut 8 and a front cover strut 9 which are hinge-mounted to one another in their longitudinal direction for relative pivotal motion about an axis extending along the strut lengths. The hinge results from the top edge of the cover strut 9 being provided with a thickened edge 10 which is framed or retained in a rotatable manner in a groove 11 of the base strut 8.

The cloth 2 is fixed at its front edge to the base strut 8 near the thus formed hinge. This front edge surrounds, for example, a bar 12 which is retained in a groove 13 of the base strut 8.

The struts 8 and 9 are shaped such that, when the cloth 2 is rolled entirely on the roller 4, the rear base strut 8 fits up with a top edge against the strut 6 of the fixed part 3, and largely seals the opening of the strut 6 with its remainder, whereas the cover strut 9, when turned maximally backwards, and when it thus fits up against the base strut 8, forms a closed storage area together with this base strut 8.

In the unrolled position of the cloth 2, the front part 5 is supported by two folding supporting arms 14 which can be adjusted in the length, which, for the sake of simplicity, are only represented in FIG. 1. These supporting arms 14 are hinge-mounted to the base strut 9 at the ends of the front part 5, and, when not in use, they are folded and stored in a groove-shaped part 15 of the base strut 8, which part is sealed by the cover strut 9 in turned-up position.

Figure 2:
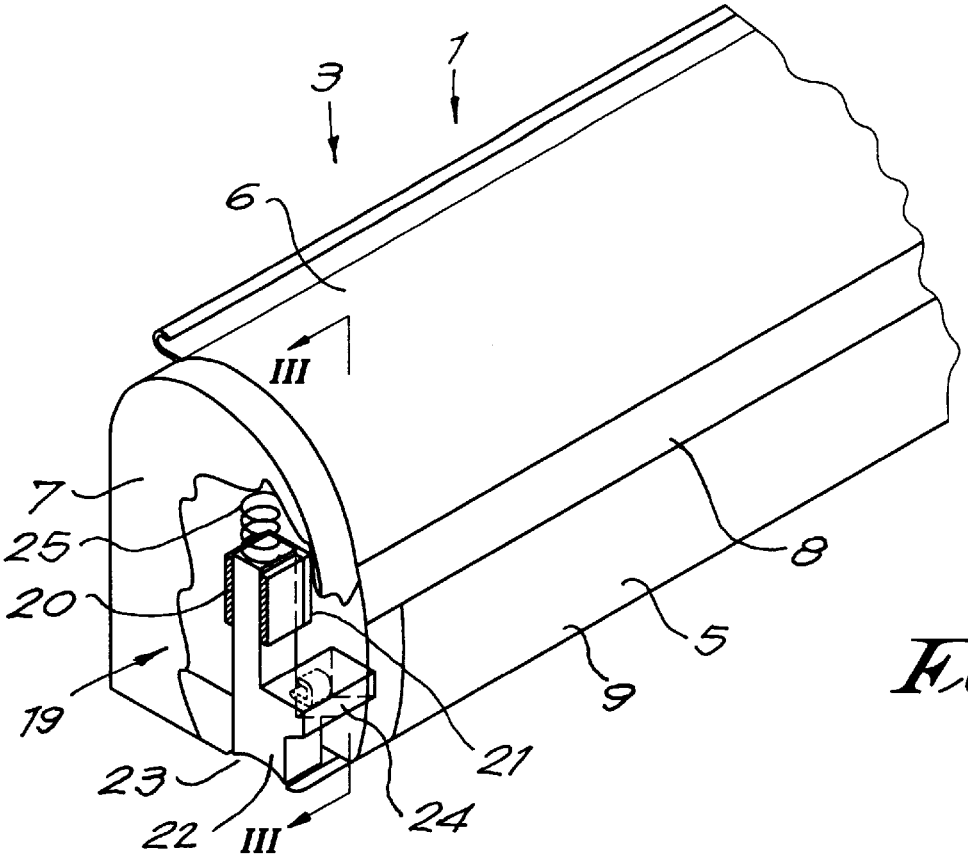
FIG. 2 shows a view in perspective of an end of the awning of FIG. 1, when the cloth is entirely rolled up and when the front part of the supporting frame is in closed position.
Figure 3:
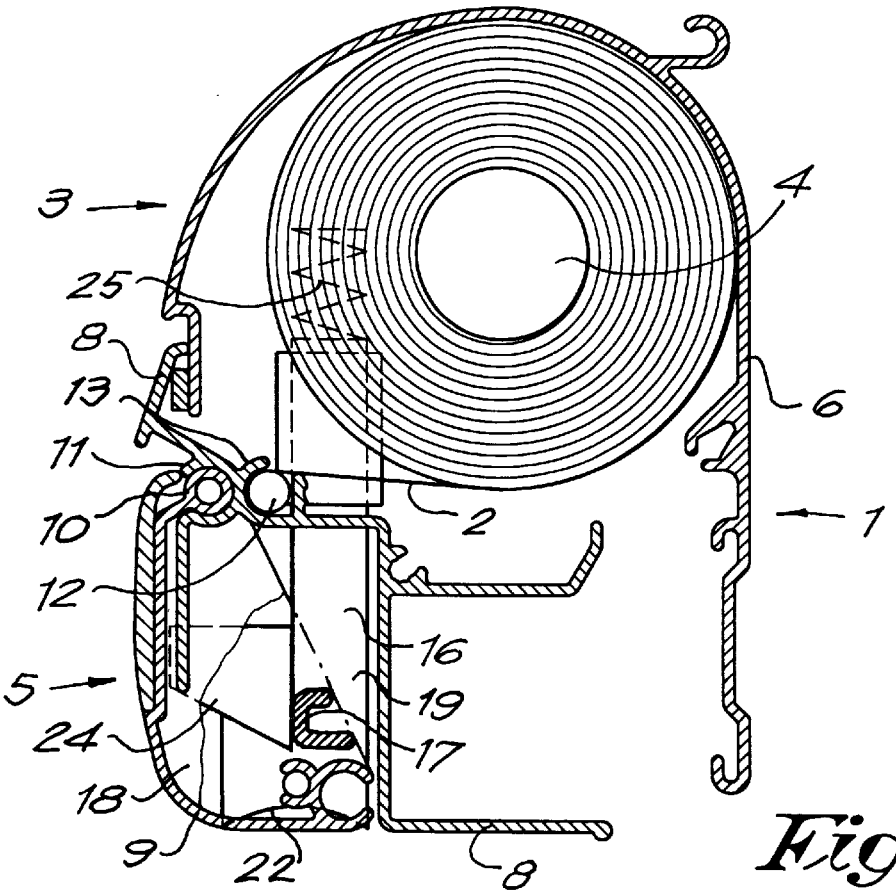
FIG. 3 shows a section according to the line III—III in FIG. 2, drawn to a larger scale.

FIGS. 2 and 3 represent the struts 6, 8 and 9 in the above-described position, where the cloth 2 is rolled up, the base strut 8 fits up against the strut 6 and the cover strut 9 is turned up against the base strut 8.

The invention has a unique locking device on both ends to lock the above-mentioned struts in the above-mentioned position.

Each locking device consists of a locking element 16 which is mounted such that it can slide up and down on the inside of an end part 7 of the fixed part 3 and which cooperates with a catch 17 which is provided on an end part 18 which is fixed on one end of the cover strut 9 and which thus forms part of the movable front part 5 of the supporting frame 1.

The locking element 16 can be moved up and down and contains a vertical, rod-shaped part 19 which is mounted in a sliding manner in a groove, formed by the end part 7 and two walls 20 standing thereupon, and it is kept in this groove by a strip or channel 21 which runs between the walls 20.

The bottom end of this part 19 forms a push button 22 and, when the locking element 16 is in the locking position, i.e., the lowest position represented in FIG. 2, it is situated just opposite an opening 23 in an edge of the end part 7 or in the end of the strut 6.

Against the side on the rod-shaped part 19 turned towards the roller 4, there is provided an active part or latch 24 which, on the front side and on the side turned towards the roller 4, sticks out of the part 19 and whose bottom side is bevelled, i.e., which is directed slantingly downward and rearward to present a cam surface.

A spring 25 pushes the locking element 16 and latch 24 downward in relation to the end part 7 into the above-mentioned locking position.

When the cloth 2 is entirely rolled up and the base strut 8 is turned backward, the catch 17 of the cover strut 9 is situated right on the backside of the active part or latch 24 of the locking element 16 in the locking position, as is shown in FIGS. 2 and 3.

In this position, the locking element 16 prevents the cover strut 9 from pivoting forward and, as a consequence, also prevents a forward movement of the base strut 8, so that the cloth 2 cannot be unrolled.

Figure 4:
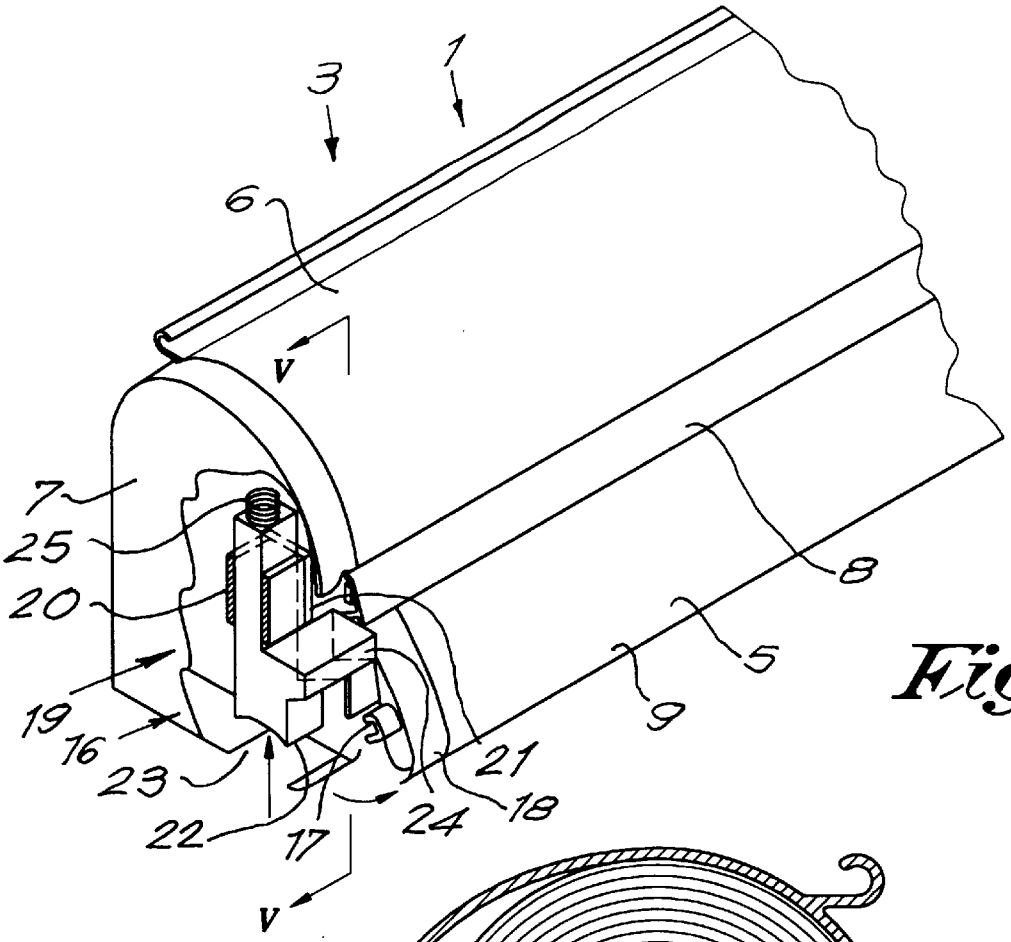
FIG. 4 shows a view in perspective of an end of the awning analogous to that in FIG. 2, but with the front part of the supporting frame in the open position.
Figure 5:
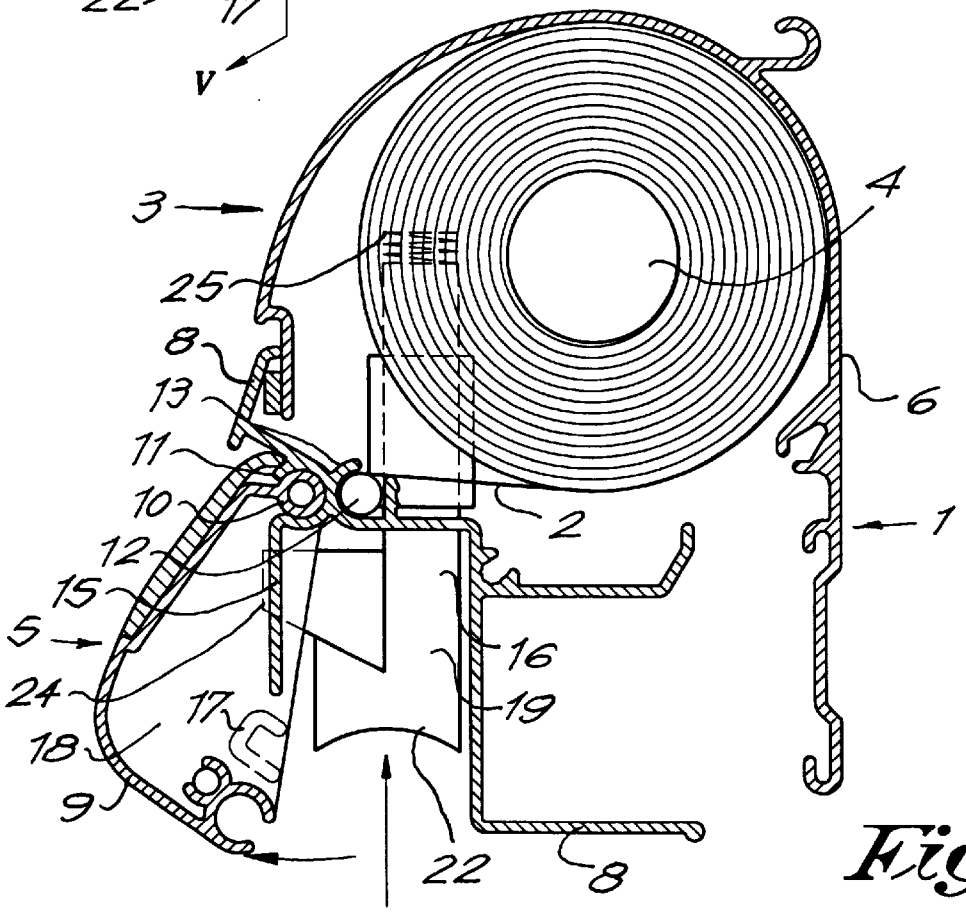
FIG. 5 shows a section according to line V—V in FIG. 4, drawn to a larger scale.
Figure 6:
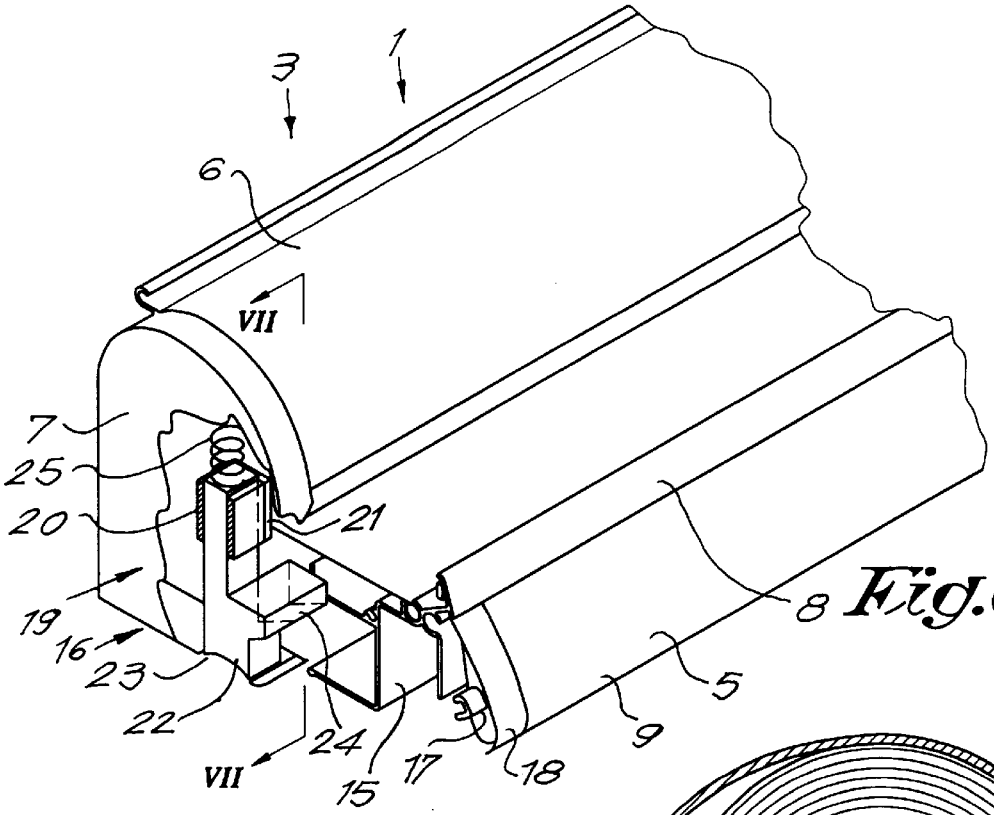
FIG. 6 shows a view in perspective of an end of the awning analogous to that in FIGS. 2 and 4, but with the cloth partially unrolled.
Figure 7:
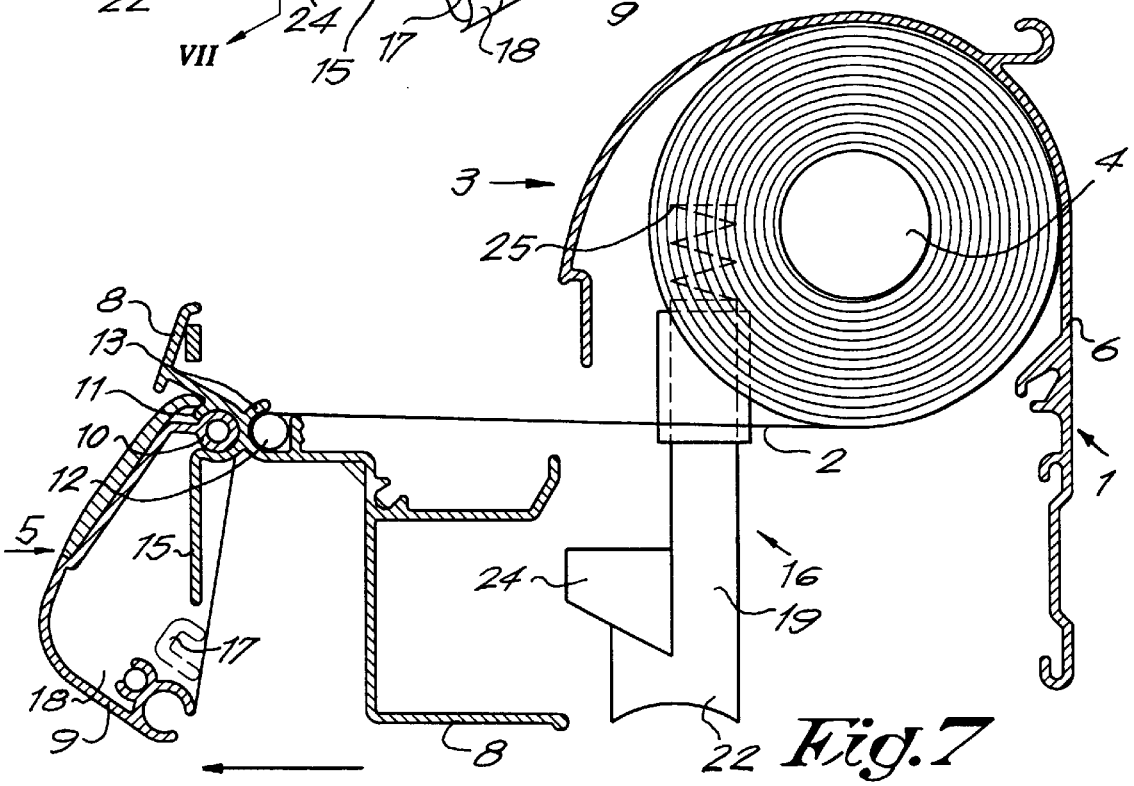
FIG. 7 shows a section according to line VII—VII in FIG. 6, drawn to a larger scale.

By pushing the locking element 16 upward, against the action of the spring 25, the active part or latch 24 can be brought above the catch 17, so that the latter is released and the cover strut 9 can pivot forward in relation to the base strut 8, as is shown in FIGS. 4 and 5 with the path of motion of the catch 17 clearing the bottom of the part 24.

This pivoting forward is promoted by a spring which is not represented in the figures and which biases the struts 8 and 9 apart.

The working of the above-mentioned manually unrolling awning is as follows:

In rolled-up and locked position of the awning, i.e., the position shown in FIGS. 2 and 3, at each end of said awning, a locking element 16 positively holds the front part 5 against the fixed part 3 in an awning locked position through the agency of the catch 17. The supporting arms 14 are thereby folded and retained in the space between the base strut 8 and the cover strut 9.

In order to open the awning, the user at one end pushes the locking element 16 and latch 24 upward into an awning release position represented in FIG. 5 by pressing on the push button 22 upward. Immediately afterwards, the cover strut 9 will open up slightly forwardly on said end, so that the catch 17 will pass below part 24 away from the locking element 16 forwardly on said end. When the locking element 16 is released, the active part or latch 24 can no longer return in front of the catch 17, but drops behind the catch.

Subsequently, the user unlocks the other end in a similar manner, so that also on this end the cover strut 9 is released.

This condition is shown in FIGS. 4 and 5.

The user then takes hold of the cover strut 9 as a handle and draws the base strut 8 forwardly with it, so that the cloth 2 attached to it is unrolled.

When it is sufficiently unrolled, the user unfolds the supporting arms 14. Also in unrolled position, the cloth 2 is secured and possibly also stretched by means of one or several telescopic supports which are not represented in the drawings.

When the front part 5 of the supporting frame 1 is free and released, the cloth 2 is rolled up automatically by means of a clamped spring mounted in the roller 4 which was tensioned as the cloth was unrolled.

During this rolling up, the supporting arms 14 are stored in the groove-shaped part 15 of the base strut 8.

The cloth 2 is entirely rolled up when the base strut 8 fits up against the strut 6 in an awning rolled position.

The user finally pivots up the cover strut 9 on both ends of the awning, i.e., he turns it backward to an awning locked position. The catch 17 that is positioned on an end of the strut 9 engages the bevelled bottom side of the active part or latch 24 of the locking element 16 on a corresponding end part of fixed part 3, so that when pivoting up and following its path of motion, the catch 17 lifts up the locking element 16 by a camming action until the active part or latch 24 is raised and then drops to the front side of the catch 17 by the spring 25. As a result, the cover strut 9, which is then in closed or awning locked position, is positively locked.

The locking elements cannot be seen from the outside, so that they do not disturb the aesthetics of the design. However, they make it possible to simply lock the front part 5 of the supporting frame in closed position, also with manually unrolling awnings.

The present invention is by no means restricted to the above-described embodiment as represented in the accompanying drawings; on the contrary, such a manually unrolling awning can be made in all sorts of variants while still remaining with the scope of the invention.

I claim:

1. A manually operable awning assembly comprising:

a supporting frame including a fixed rear part and a relatively movable front part, said fixed part including at least one end portion;

a roller for an awning cloth supported for rotation in the fixed part, said front part including a device for securing thereto a front edge of an awning cloth wound on the roller;

at least one locking element associated with said at least one end portion of said fixed part and movable relative to said end portion between an awning released and an awning locked position;

said front part being movable away from and towards said fixed part between awning released and awning locked positions, respectively, and including at least one catch element that cooperates with the locking element when the front part is located in an awning locked position to positively secure the front part from moving away from the fixed part unless the locking element is moved to an awning released position;

said locking element being movable vertically upwardly and downwardly, having upper and lower portions, and comprising a rod-shaped part defining a push button operator for the locking element located at a lower end of the lower portion thereof, and a latch element movable in response to motion of the rod-shaped part and located so as to cooperate with the catch element when the front part is in the awning locked position to positively secure the catch element and the front part against motion away from the locking element unless the latch element is moved away from a path of motion of the catch element when the front part is moved away from the fixed part.

2. The awning assembly according to claim 1, including a second locking element corresponding to the first-recited locking element associated with a second end portion of said fixed part, and a second catch element corresponding with said first-recited catch element associated with said second locking element.

3. The awning assembly according to claim 1, said fixed part including a lengthwise extending strut and opposed end portions associated with the strut, and wherein said at least one end portion is one of said opposed end portions.

4. The awning assembly according to claim 1, wherein said latch element is movable vertically up and down with said locking element, and including a resilient biasing device for resiliently biasing the latch towards a downward position, the path of motion of said catch element when the front part is moved relative to the fixed rear part extending beneath the latch element when the latch element is in a raised position.

5. The awning assembly according to claim 4, said latch element including a downwardly and rearwardly beveled surface located so as to be engageable by said latch element when the latch element is in a lower position and the catch element moves along a path of motion when the front part is moved to an awning locked position to cause the latch element to be raised against the resilient bias force tending to lower the latch element and to clear the path of motion of the catch element in a direction towards an awning locked position until the catch element has passed below the latch element, whereupon the downward motion of the latch element in response to the downward bias returns the latch element into the path of motion of the catch element extending in a direction towards an awning released position to thereby positively prevent said front part from moving away from the fixed part.

6. A manually operable awning assembly comprising:

a supporting frame including a fixed rear part and a relatively movable front part, said fixed part including at least one end portion;

a roller for an awning cloth supported for rotation in the fixed part, said front part including a device for securing thereto a front edge of an awning cloth wound on the roller;

at least one locking element associated with said at least one end portion of said fixed part and movable relative to said end portion between an awning released and an awning locked position;

said front part being movable away from and towards said fixed part between awning released and awning locked positions, respectively, and including at least one catch element that cooperates with the locking element when the front part is located in an awning locked position to positively secure the front part from moving away from the fixed part unless the locking element is moved to an awning released position said front part including a pair of parallel elongated struts hinged together for relative pivotal movement about an axis extending parallel to the strut lengths, one of said struts comprising a base strut and the other comprising a front cover strut, said catch being secured to the front cover strut.

7. The awning assembly according to claim 6, said cover strut including at least one end part, said catch being affixed to said end part.

8. The awning assembly according to claim 6, said pair of elongated struts having a shape that defines an interior storage space for support struts associated with the front part when the elongated struts are pivoted into close proximity with each other.

9. The awning assembly according to claim 6, said device for securing to the front part the front edge of an awning cloth comprising part of said front cover strut, and wherein said front cover strut is a handle for manipulating an awning cloth secured thereto.

* * * * *